US006773318B1

(12) United States Patent
Albright

(10) Patent No.: US 6,773,318 B1
(45) Date of Patent: Aug. 10, 2004

(54) PERSONAL FLOATATION DEVICE

(75) Inventor: Scott Albright, Ventura, CA (US)

(73) Assignee: Lotus Designs, Inc., Reno, NV (US)

( * ) Notice: Subject to any disclaimer, the term of this patent is extended or adjusted under 35 U.S.C. 154(b) by 0 days.

(21) Appl. No.: 10/386,054

(22) Filed: Mar. 11, 2003

(51) Int. Cl.[7] ..... B63C 9/08

(52) U.S. Cl. ..... 441/118

(58) Field of Search ..... 441/106, 108, 441/112, 113, 117, 118

(56) References Cited

U.S. PATENT DOCUMENTS

| | | | | | |
|---|---|---|---|---|---|
| 2,389,735 | A | | 11/1945 | Morner | 9/20 |
| 3,266,070 | A | * | 8/1966 | O'Link | 441/112 |
| 4,167,051 | A | | 9/1979 | Galecke | 9/329 |
| 4,263,686 | A | | 4/1981 | Jarvis, Jr. | 9/341 |
| D279,595 | S | * | 7/1985 | Evert | D21/805 |
| 4,578,042 | A | * | 3/1986 | Evert | 441/117 |
| 5,632,235 | A | * | 5/1997 | Larsen et al. | 119/856 |
| 5,759,076 | A | | 6/1998 | Bateman et al. | 441/115 |
| D423,622 | S | | 4/2000 | Wagner | D21/805 |
| 6,447,353 | B1 | | 9/2002 | Henry | 441/106 |

FOREIGN PATENT DOCUMENTS

| | | |
|---|---|---|
| GB | 2 060 510 | 10/1979 |

* cited by examiner

*Primary Examiner*—S. Joseph Morano
*Assistant Examiner*—Lars A. Olson
(74) *Attorney, Agent, or Firm*—Khorsandi Patent Law Group, A Law Corp.; Marilyn R. Khorsandi

(57) ABSTRACT

The present invention provides a personal floatation device comprising a back floatation package extending horizontally, latitudinally (when worn) across an upper back shoulder portion of the vest from an upper right back shoulder portion to an upper left back shoulder portion. The back floatation package of the present invention has a lower edge that extends horizontally (latitudinally) from a rear left-arm mid-sleeve position to a rear right-arm mid-sleeve position. The present invention further comprises a back non-floatation anchoring means that is connected to the lower edge of the back floatation package. The back non-floatation anchoring means extends vertically (longitudinally) from the lower edge of the back floatation package to a waist of the vest. In various embodiments, the back non-floatation anchoring means may comprise a panel of material, a panel of mesh material, a configuration of straps, either adjustable or non-adjustable, or other anchoring means. In the exemplary embodiment, the back non-floatation panel extends horizontally (latitudinally) from a right side portion of a back of the vest to a left side portion of the back of the vest.

20 Claims, 6 Drawing Sheets

FIG. 3
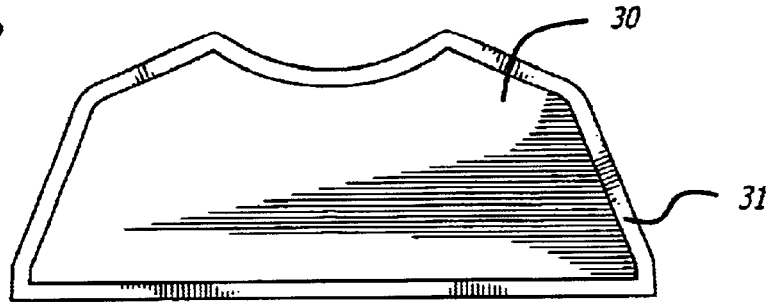
FIG. 4
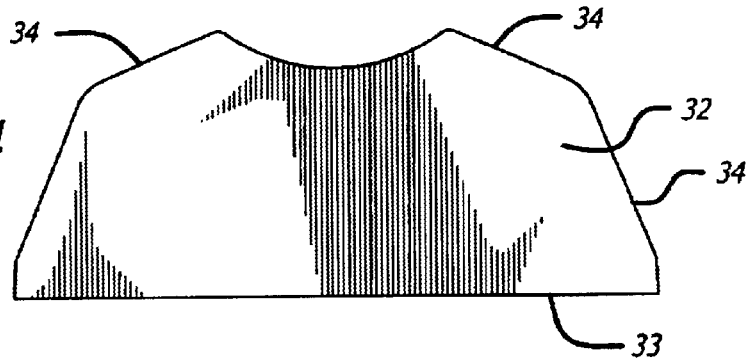
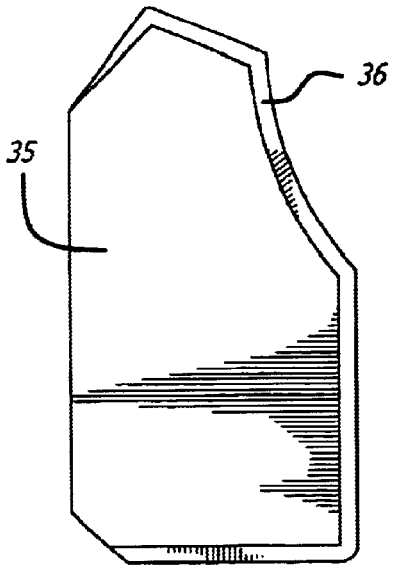
FIG. 5
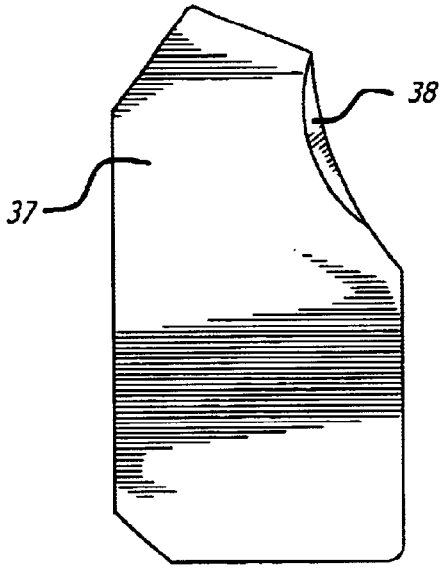
FIG. 6

PERSONAL FLOATATION DEVICE

FIELD OF THE INVENTION

The field of the present invention is floatation devices, and more specifically, personal floatation devices, also referred to as life vests or life jackets.

BACKGROUND OF THE INVENTION

Many personal floatation devices ("PFD", "PFD's") provide a back floatation package that is connected to two front floatation packages to form a vest. Floatation packages are generally made of material such as foam. Floatation packages made of foam are bulky.

Many PFD's arrange the foam in both of the two front floatation packages and in the back floatation package to fit the wearer's body beginning just above the wearer's waist and extending upward to the wearer's shoulders. Most PFD's provide a generally equal distribution of foam in the front and back floatation packages, with just slightly more foam in the front.

There is a drawback to such PFD's in situations where the wearer sits in a chair with a back support structure. For example, kayaks and other boats have seats with back supports. As a consequence of the back floatation package of most PFD's being made of foam that fits just above the wearer's waist, when the wearer wears the vest and tries to sit in a chair with a back support structure, the foam in the back floatation package of the vest interferes with the back support of the chair. The result of wearing such a PFD in a chair with a back support is that the body of the wearer is forced forward in such a back-supported seat. Such forward-sitting prevents the wearer from sitting safely, comfortably, and securely in a back-supported seat.

SUMMARY OF THE INVENTION

The present invention provides a personal floatation device comprising a back floatation package extending horizontally, latitudinally (when worn) across an upper back shoulder portion of the vest from an upper right back shoulder portion to an upper left back shoulder portion. The back floatation package of the present invention has a lower edge that extends horizontally (latitudinally) from a rear left-arm mid-sleeve position to a rear right-arm mid-sleeve position. The present invention further comprises a back non-floatation anchoring means that is connected to the lower edge of the back floatation package. The back non-floatation anchoring means extends vertically (longitudinally) from the lower edge of the back floatation package to a waist of the vest. In various embodiments, the back non-floatation anchoring means may comprise a panel of material, a panel of mesh material, a configuration of straps, either adjustable or non-adjustable, or other anchoring means. In the exemplary embodiment, the back non-floatation panel extends horizontally (latitudinally) from a right side portion of a back of the vest to a left side portion of the back of the vest.

It should be noted that herein, the terms "horizontally" and "latitudinally" are both used interchangeably herein to refer to elements of the present invention that, when an embodiment of the present invention is in an upright position such as when it is worn, or is in an upright position as to be worn, or is hung upright on a clothes hanger, extend from one side, e.g., the left side, to another side, e.g., the right side, of the vest of the present invention.

The terms "vertically" and "longitudinally" are both used interchangeably herein to refer to elements of the present invention that, when an embodiment of the present invention is in an upright position such as when it is worn, or is in an upright position as to be worn, or is hung upright on a clothes hanger, extend from a point at one level to a point at a lower level of the vest of the present invention.

It will be understood by someone with ordinary skill in the art that the present invention is a type of garment that can be placed in various positions or folded in any number of variations; certain spatially-relevant descriptive terms used herein are used to describe the relative positions of elements of the present invention when an embodiment of the present invention is in an upright position such as when it is worn, or is in an upright position as to be worn, or is hung upright on a clothes hanger; that when an embodiment of the present invention is in some alternative position, such as, for example, laying flat, folded, stuffed into a duffle bag, or hung upside down from or folded over a clothes line, the elements described will be in positions other than as described herein.

In one exemplary embodiment of the present invention, the vest further comprises a first connecting means extending horizontally through a mid-back-level portion of the back non-floatation panel.

In a further exemplary embodiment of the present invention, the vest further comprises a second connecting means extending horizontally through an above-waist-level portion of the back non-floatation panel.

In a still further exemplary embodiment of the present invention, the vest further comprises a third connecting means extending horizontally through a waist-level portion of the back non-floatation panel.

In a yet further exemplary embodiment of the present invention, the vest further comprises a left front floatation package having a left front shoulder portion, a right front floatation package having a right front shoulder portion, a right connecting means connecting the right back shoulder portion to the right front shoulder portion, and a left connecting means connecting the left back shoulder portion to the left front shoulder portion.

In another exemplary embodiment of the present invention, the vest comprises a floatation package comprising a front portion and a back portion, the back portion of said floatation package fitting high on a wearer's back shoulders, the back portion of said floatation package having a lower edge; the vest further comprising a back non-floatation panel connected to the lower edge of the back portion of the floatation panel, said back non-floatation panel extending vertically from the lower edge of the back portion of the floatation package to a waist of the vest.

BRIEF DESCRIPTION OF THE DRAWINGS

These and other features of the present invention are more fully set forth in the following description of exemplary embodiments of the invention. The description is presented with reference to the accompanying drawings in which:

FIG. 3 is a plan view of an exemplary back floatation package shell foam package in an exemplary embodiment of the present invention;

FIG. 4 is a plan view of an exemplary back floatation package shell envelope in an exemplary embodiment of the present invention;

FIG. 5 is a plan view of an exemplary top front left foam package in an exemplary embodiment of the present invention;

FIG. 6 is a plan view of an exemplary bottom from right foam package in an exemplary embodiment of the present invention;

DETAILED DESCRIPTION OF THE INVENTION

Figure 1:
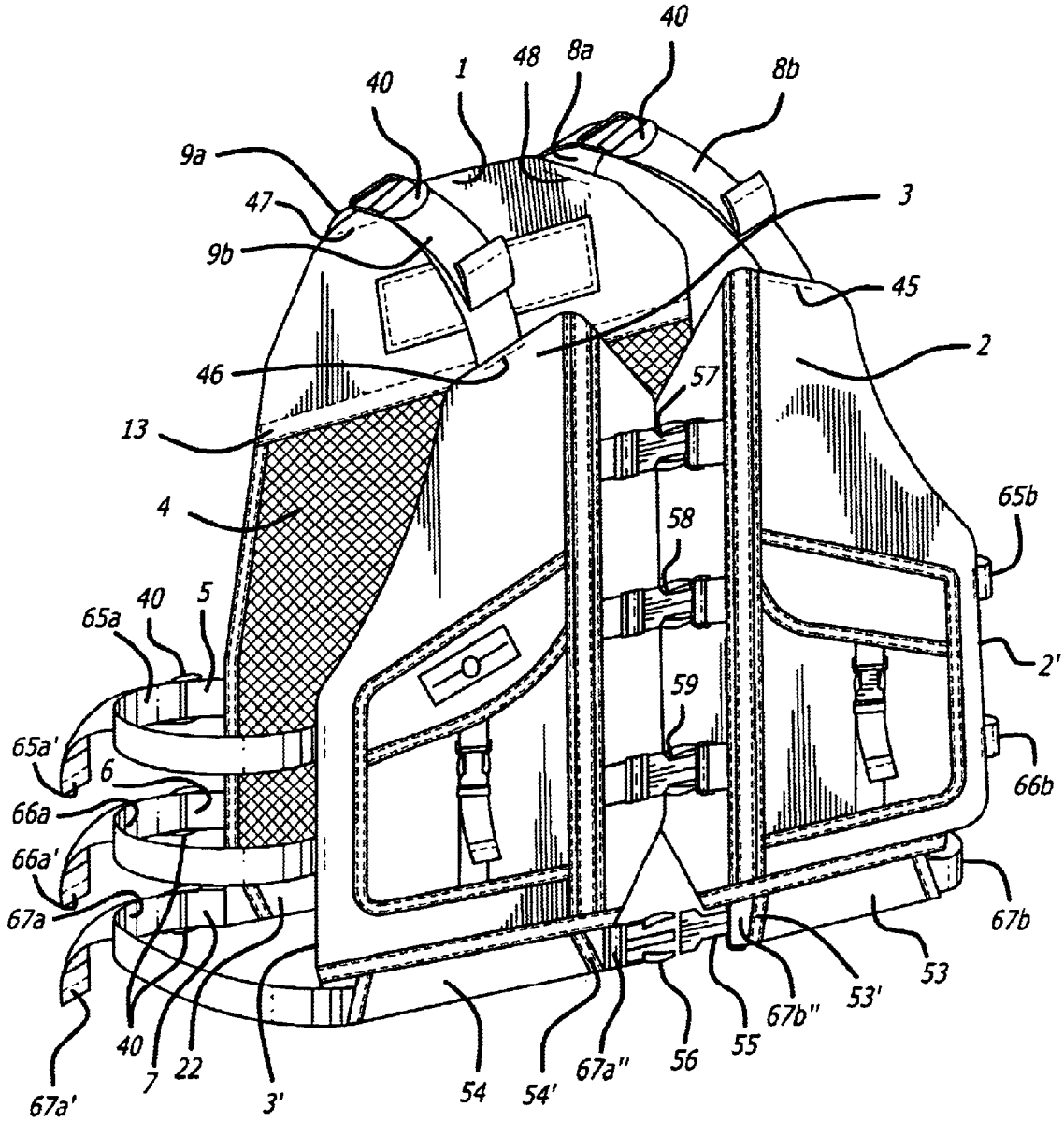
FIG. 1 is a perspective view of an exemplary personal floatation device ("PFD") of the present invention.
Figure 2:
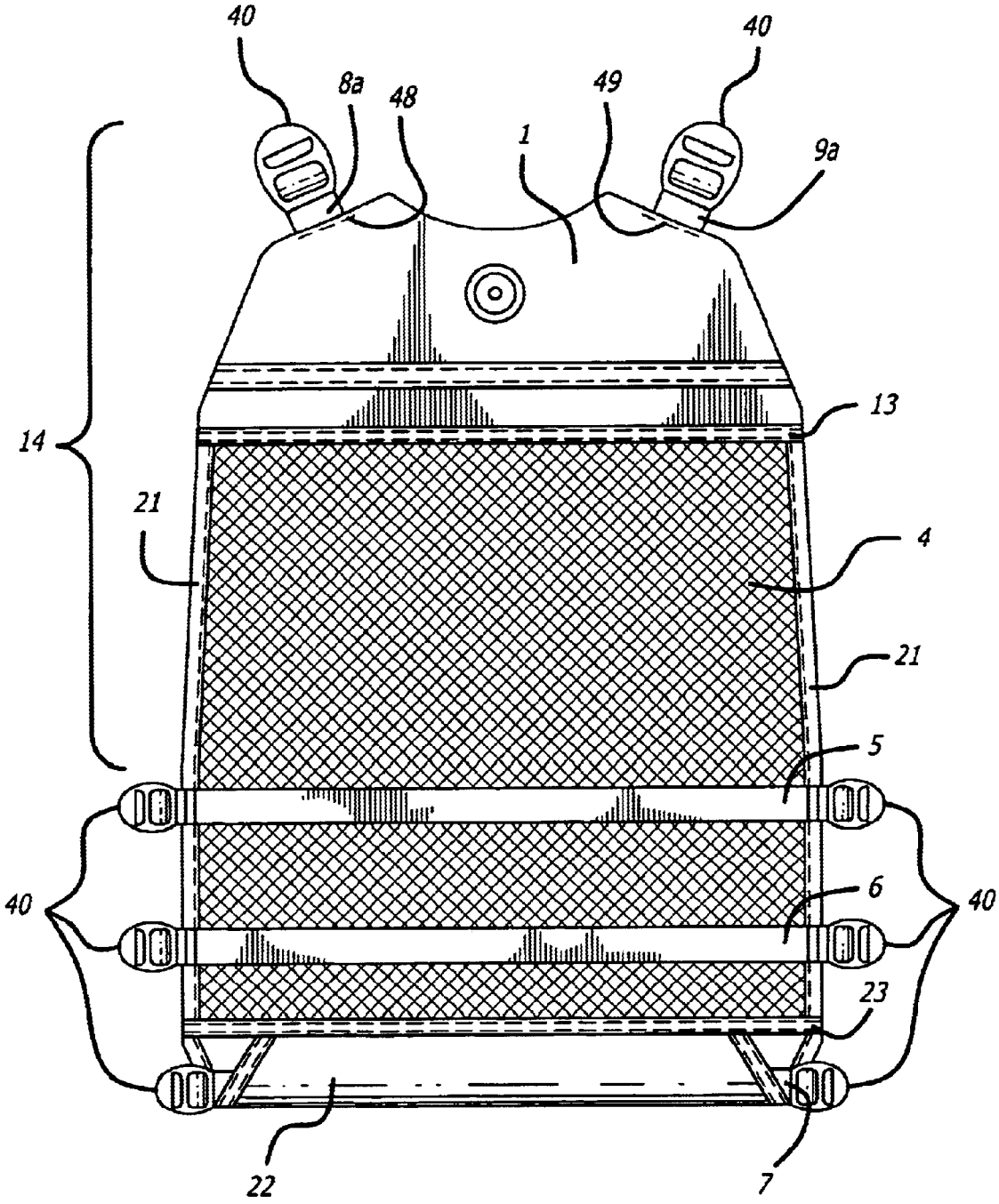
FIG. 2 is a plan view of the back portion of the exemplary PFD of the present invention.

FIG. 1 is a perspective view of an exemplary PFD of the present invention. FIG. 2 is a plan view of the back portion of the exemplary PFD of the present invention. As depicted in FIGS. 1 and 2, the exemplary embodiment of the present invention provides a back floatation package 1. The back floatation package 1 is connected to a back non-floatation panel 4. The back non-floatation panel 4 of the exemplary embodiment of the present invention connects at an edge 13 to the back floatation package 1.

The back floatation package 1 of the exemplary embodiment of the present invention is generally formed in the shape of a shoulder yoke, such as a shoulder yoke panel on the upper back shoulders of a men's sport shirt. The back floatation package 1 is designed to fit the upper back shoulder yoke position 10 of a wearer 12 (see FIGS. 9 and 10). FIG. 10 is a back view of a person 12, depicting a projection of a back floatation package 1' of the present invention onto the upper back shoulder yoke position 10 of the person 12.

As depicted in FIGS. 3 and 4, the back floatation package 1 (see, e.g., FIG. 2) of the exemplary embodiment of the present invention is constructed with a yoke-shaped shell envelope 32 of material initially providing an opening at the bottom edge 33. A foam package 30 with a skive 31 (a skive is a beveled edge) is inserted into the yoke-shaped shell envelope 32 of material. The foam package 30 is inserted. The bottom of the shell envelope, with the foam package 30 inserted, and a top edge of the back non-floatation panel inserted, is closed, such as by stitching.

Figure 9:
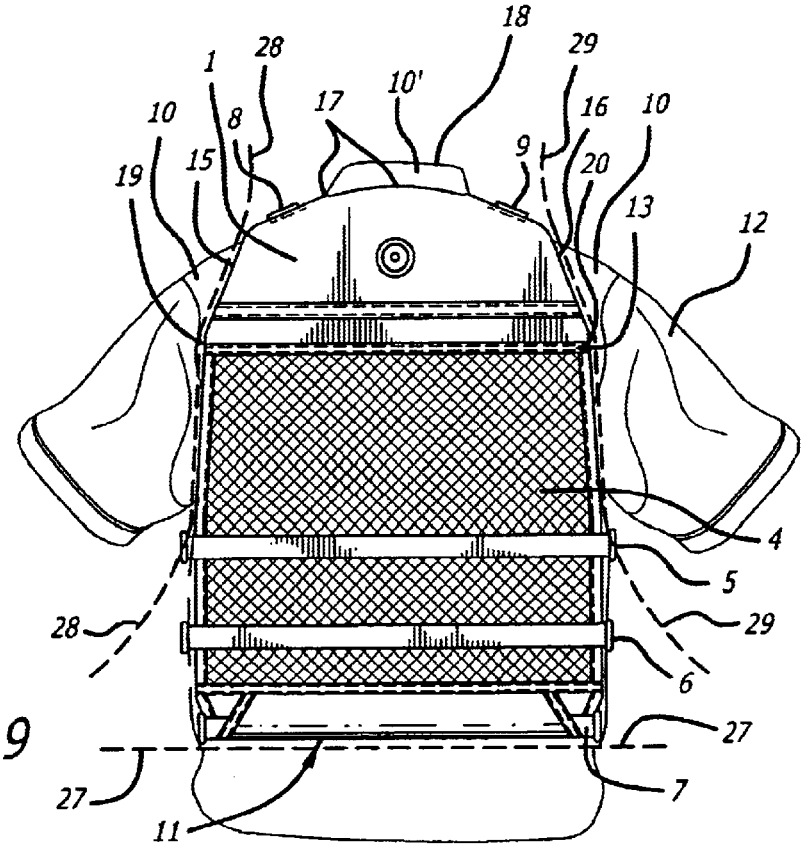
FIG. 9 is a back view of the exemplary vest of the present invention as fitted on a wearer.
Figure 10:
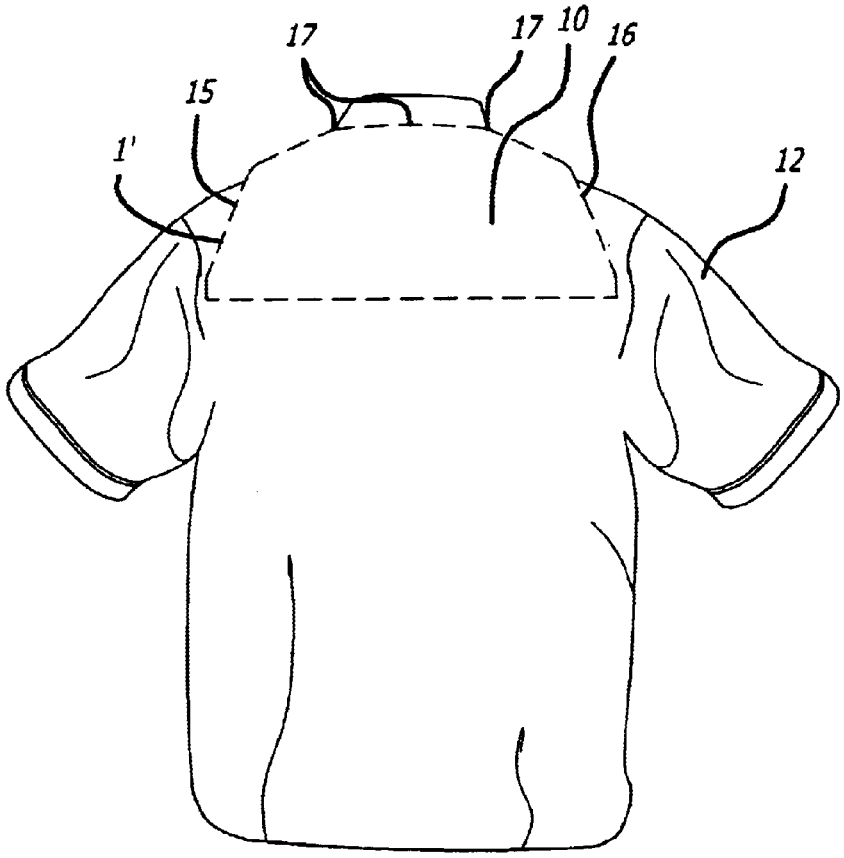
FIG. 10 is a back view of a person, depicting a projection of an exemplary back floatation package of the present invention onto the back shoulders of the person.

As depicted in FIGS. 9 and 10, the back floatation package 1 of the exemplary embodiment of the present invention extends horizontally, latitudinally (when the exemplary vest of the present invention is in an upright "worn" position) across an upper back shoulder yoke portion 10' of the vest of the present invention from an upper left back shoulder position 15 to an upper right back shoulder position 16. As depicted in FIGS. 9 and 10, the back floatation package has a top 17. The top 17 of the exemplary back floatation package 1 begins at the rear neck collar position 18 of the wearer 12. As depicted in FIG. 9, the back floatation package 1 of the exemplary embodiment of the present invention has a lower edge 13 that extends horizontally (latitudinally) from a rear left-arm mid-sleeve position 19 to a rear right-arm mid-sleeve position 20.

As depicted in FIG. 2, the back floatation package 1 of the exemplary embodiment of the present invention has upper back left and right shoulder edges 48 and 49 respectively. In the exemplary embodiment of the present invention, straps 8*a* and 9*a* are sewn to the upper back left and right shoulder edges 48 and 49 respectively. The ends of straps 8*a* and 9*a* are threaded through strap adjustment features 40 (e.g., "Ladder Locs"), are turned back and sewn across the upper back left and right shoulder edges 48 and 49 respectively.

The back non-floatation panel 4 of the exemplary embodiment of the present invention is comprised of mesh. Someone with ordinary skill in the art will understand that mesh is exemplary and is illustrative of the type of material that can be used as the back non-floatation panel 4 and is not a limitation of the invention.

The back non-floatation panel 4 of the exemplary embodiment of the present invention is connected to the back floatation package 1 at the lower edge 13 of the back floatation package 1. Binding tape 21 is sewn along both sides of the back non-floatation panel 4 of the exemplary embodiment of the present invention. A panel of material is sewn to the bottom 23 of the back non-floatation panel 4 and is doubled back and sewn to form a tunnel 22. The tunnel 22 is a waist securing means through which a strap may be inserted.

The exemplary embodiment of the present invention provides straps 5, 6, and 7 across the back non-floatation panel 4. In the exemplary embodiment of the present invention, straps 5, 6 and 7 comprise nylon webbing. In the exemplary embodiment of the present invention, Strap 5 is sewn horizontally (latitudinally) across the back non-floatation panel 4 at approximately a mid-rib position. Strap 7 is inserted through the tunnel 22. Strap 6 is sewn horizontally (latitudinally) across the back non-floatation panel 4 in between Straps 5 and 7. Straps 5, 6 and 7 reinforce the structure of the back non-floatation panel 4. Further, straps 5, 6 and 7 provide strength for adjusting the fit of back 1 and front 2 and 3 (see FIG. 1) floatation packages on a wearer. The ends of straps 5, 6 and 7 threaded through strap adjustment features 40 (e.g., "Ladder Locs"), are turned back and sewn across the binding 21 on the respective edges of the back non-floatation panel. When the exemplary vest of the present invention is worn by a person, the tunnel 22 and strap 7 are designed to be positioned at the waist of the wearer.

Reference herein to a "waist" of the vest will be understood to include the portion of the vest that touches or reaches, or the portions of the components of the vest that touch or reach, the approximate location of a wearer's waist. For example, shoulder straps (e.g. elements 8*a*, 8*b*, and 9*a*, 9*b*, described further below) of the exemplary vest of the present invention can be adjusted so that the tunnel 22, and tunnels 53 and 54 as described further below, will reach waist-level of a wearer; straps 7, 67*a* and 67*b* would then encircle the wearer's waist.

As depicted in FIG. 1, the exemplary embodiment of the present invention further provides two front floatation packages 2 and 3. Each of the two front floatation packages 2 and 3 have upper shoulder edges 45 and 46 respectively. In the exemplary embodiment of the present invention, straps 8*b* and 9*b* are sewn to the upper front left and right shoulder edges 45 and 46 respectively. Continuing with reference to FIG. 1, the ends of straps 8*b* and 9*b* are threaded through strap adjustment features 40 (e.g., "Ladder Locs") that are attached to straps 8*a* and 9*a* respectively. The ends of straps 8*b* and 9*b* are turned back through the respective strap adjustment features 40; a double-fold tab is sewn at the end of each of straps 8*b* and 9*b*. Shoulder strap assemblies, e.g., strap 8*a* with strap 8*b* with strap adjustment feature 40; and strap 9*a* with strap 9*b* with strap adjustment feature 40, are adjustable.

Figure 7:
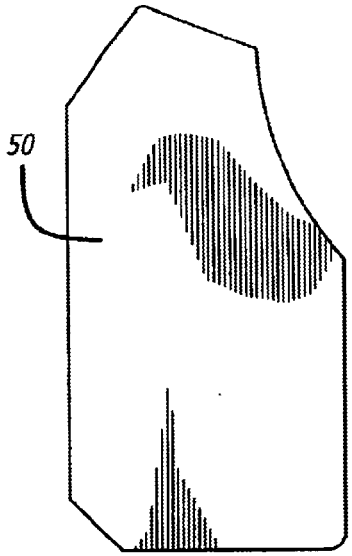
FIG. 7 is a plan view of an exemplary left front floatation package shell envelope in an exemplary embodiment of the present invention.
Figure 8:
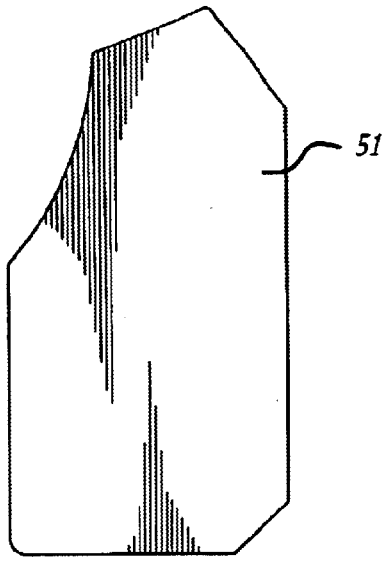
FIG. 8 is a plan view of an exemplary right front floatation package shell envelope in an exemplary embodiment of the present invention.

Each front floatation package 2 and 3 (as shown in FIG. 1) of the exemplary embodiment is constructed by inserting two foam packages, a top foam package 35 as depicted in FIG. 5, and a bottom foam package 37 as depicted in FIG. 6, into each of right and left front floatation package shell envelopes 50 (FIG. 7) and 51 (FIG. 8) respectively.

The exemplary top foam package 35 depicted in FIG. 5 is for a left front (left from the wearer's perspective) floatation package 2. The exemplary top foam package 35 depicted in FIG. 5 has a skive (a beveled edge) 36. When the top foam package 35 is inserted into a floatation package, the top foam package 35 is inserted with the skived side facing out (away from the wearer).

The exemplary bottom foam package 37 depicted in FIG. 6 is for a right front (right from the wearer's perspective) floatation package 3. The exemplary bottom foam package 37 depicted in FIG. 6 has a skive 38. When the bottom foam package 37 is inserted into a floatation package, the bottom foam package 37 is inserted with the skived side down (facing the wearer's body)—that is, the bottom foam package 37 would be turned on the reverse side from the way it is depicted in FIG. 6.

Once a top and a bottom foam package 35 and 37 respectively (FIGS. 5 and 6 respectively) are inserted into each of the right and left front floatation package shell envelopes 50 (FIG. 7) and 51 (FIG. 8) respectively, then a tunnel 53 and 54 (FIG. 1) of material is formed, such as by stitching, at the bottom of each package 2 and 3 respectively. The tunnels 53 and 54 provide waist securing means for the two front floatation packages 2 and 3 respectively through which a strap, or other strapping means, can be inserted.

Continuing with reference to FIG. 1, straps 67*a* and 67*b* are threaded through the tunnels 53 and 54. One end 67*a*' and 67*b*' (not shown) respectively of each strap 67*a* and 67*b* is threaded through strap adjustment features 40 attached to strap 7; the ends 67*a*' and 67*b*' (not shown) respectively of straps 67*a* and 67*b* that have been threaded through strap adjustment features 40 are turned back through the respective strap adjustment features 40; a double-fold tab is sewn at the end 67*a*' and 67*b*' (not shown) respectively of each of straps 67*a* and 67*b*. In the exemplary embodiment, straps 67*a* and 67*b* are made of webbing.

Continuing with reference to FIG. 1, the other end 67*a* " and 67*b*" respectively of each strap 67*a* and 67*b* is threaded through a male buckle element 56 and a female buckle element 55 respectively. Each of the buckle ends 67*a* " and 67*b*" respectively of each strap 67*a* and 67*b* is turned back and sewn to the tunnel 54 and 53 respectively at an edge 54' and 53' respectively.

Straps 66*a* and 66*b*, and 65*a* and 65*b*, are attached to the outer side edge 3' and 2' of the right and left front floatation packages 3 and 2 respectively. The other ends 66*a*' and 66*b*' (not shown), and 65*a*' and 65*b*' (not shown) respectively, of straps 66*a* and 66*b*, and 65*a* and 65*b*, are then threaded through strap adjustment features 40 attached to straps 6 and 5 respectively; a double-fold tab is sewn at the ends 66*a*' and 66*b*' (not shown), and 65*a*' and 65*b*' (not shown) respectively, of straps 66*a* and 66*b*, and 65*a* and 65*b* respectively.

Side strap assemblies, e.g., strap 5 with strap 65*a* with strap adjustment feature 40; strap 6 with strap 66*a* with strap adjustment feature 40; strap 7 with strap 67*a* with strap adjustment feature 40, are adjustable.

Continuing with reference to FIG. 1, additional strap and buckle assemblies, e.g., 57, 58, 59, are provided for closure of the front of the vest. It will be understood that the number and positioning of the front closure strap and buckle assemblies are exemplary and are not a limitation of the invention—more or fewer strap and buckle assemblies could be used without departing from the spirit of the present invention.

In the exemplary embodiment, the shoulder strap assemblies (8*a*/8*b* /40 and 9*a*/9*b*/40) can be adjusted so that the back tunnel 22 (shown in FIGS. 1 and 2) and front package tunnels 54 and 53 and the side strap assemblies (7/67*a*/40 and 7/67*b*/40) are at the waist of the wearer.

When the back tunnel 22 (shown in FIGS. 1 and 2) and front package tunnels 54 and 53 and side strap assemblies (7/67*a*/40 and 7/67*b*/40) are at the waist of the wearer, the side strap assemblies (7/67*a*/40 and 7/67*b*/40) can be adjusted to the size of the waist of the wearer so that the closure buckle assembly 56 and 55 can be closed. Closure of buckle assembly 56 and 55 at the waist of the wearer removeably fastens the back non-floatation panel 4 to the back of the wearer and thereby anchors the back floatation package 1.

Anchoring the back floatation package 1 prevents the back floatation package 1 from floating. If the back floatation package 1 were not so anchored, the back floatation package 1 would be free to flat at or above the head of a wearer 12 (FIG. 9) once the wearer 12 is in water. If the back floatation package 1 were free to float at or above the head of a wearer 12 in water, the vest would likely not float the wearer 12 high enough in the water to provide sufficient water life-saving support.

Continuing with reference to FIG. 1, anchoring the back floatation package 1 with the back non-floatation panel 4 and waist/side strap assemblies (7/67*a*/40 and 7/67*b*/40) not only prevents the back floatation package 1 from floating, but does so without substantially increasing bulkiness at the back of the wearer 12 (e.g., FIG. 9). Because of the anchoring, and because of the yoke high-on-the-back-of-the-shoulders position of the back floatation package 1, a wearer 12 can sit in a seat with a back support without interference with the back of the vest. With no added back bulkiness or interference with the back of the vest, the wearer will be able to sit with the wearer's back against the back support of a seat.

Use in the exemplary embodiment of a back non-floatation panel 4 comprised of mesh to anchor the back floatation panel provides a lightweight water-pass-through anchor for the back floatation package 1. It will be understood by someone with ordinary skill in the art that other means of anchoring the back floatation panel 1 are possible without departing from the spirit of the invention. For example, a back non-floatation panel 4 could be comprised of non-mesh material.

Figure 13:
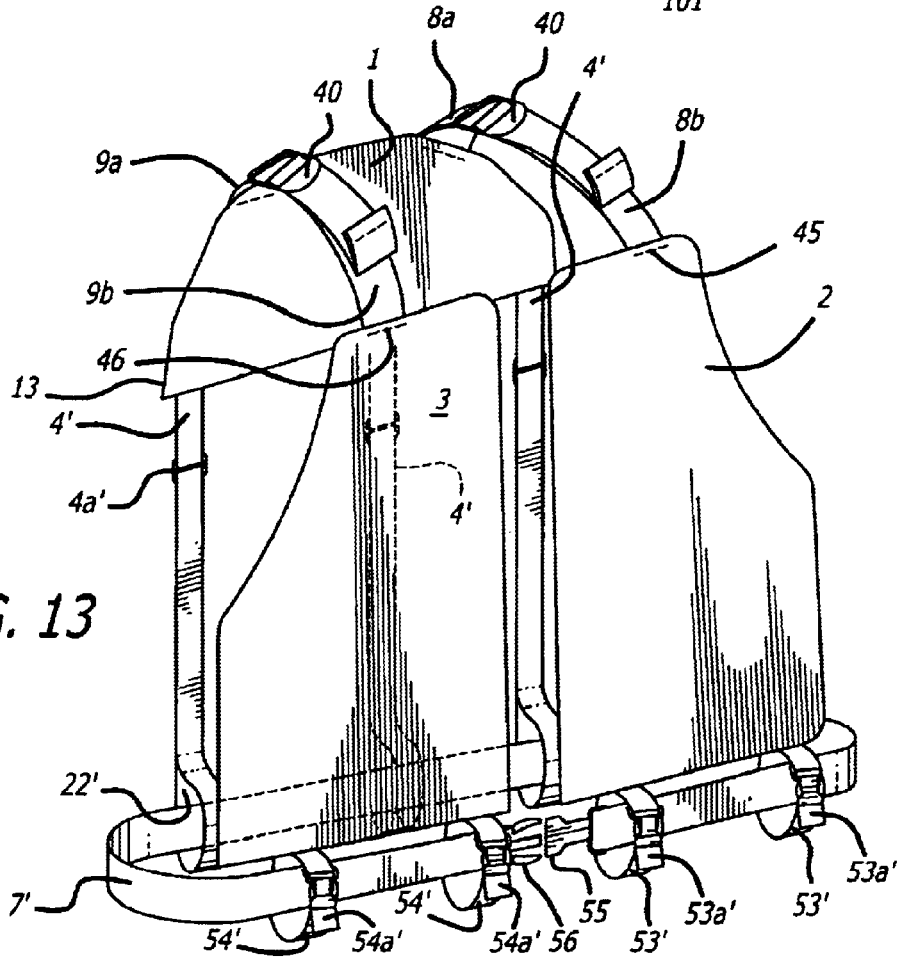
FIG. 13 is a perspective view of the front of a third alternative exemplary embodiment of the present invention.

As another example, as depicted in FIG. 13, instead of a panel of material, straps 4' could be provided to anchor the back floatation panel 1 to a waist strap 7'. FIG. 13 depicts an exemplary strap anchoring of the back floatation panel 1. As depicted in FIG. 13, vertical straps 4' are provided—one end of each vertical strap 4' would be attached to the lower edge 13 of the back floatation package 1; the opposite end of each vertical strap 4' would be looped and secured (such as with stitching) to form a tunnel 22' through which a waist strap 7' would be inserted. As depicted in FIG. 13, the vertical straps 4' would provide adjustment features 4*a*' (e.g., "Ladder Locs"); in further alternative embodiments, the vertical straps 4' may not be adjustable. The waist strap 7' could be adjustable. In further alternative exemplary embodiments, the straps 4' could be provided in non-vertical configurations, such as criss-crossed similar to the back of a man's suspenders.

In one strap anchoring embodiment, the waist strap 7' could be inserted through a tunnel (e.g., 53 and 54 as depicted in FIG. 1) of each of two front floatation panels (e.g., 2 and 3 as depicted in FIG. 1).

However, in the vertical strap anchoring embodiment depicted in FIG. 13, front tunnels 53' and 54' are loops formed by one or more adjustable straps, e.g., 53*a*' and 54*a*'. As depicted in FIG. 13, both ends of each strap 53*a*' and 54*a*' are connected to the bottom of the respective front floatation panel 2 and 3, thereby forming a tunnel 53' and 54' respectively through which the waist strap 7' can be inserted. The tunnels 53' and 54' provide waist securing means for the two front floatation packages 2 and 3 respectively through which a strap, e.g., waist strap 7', or other strapping means, can be inserted.

Figure 11:
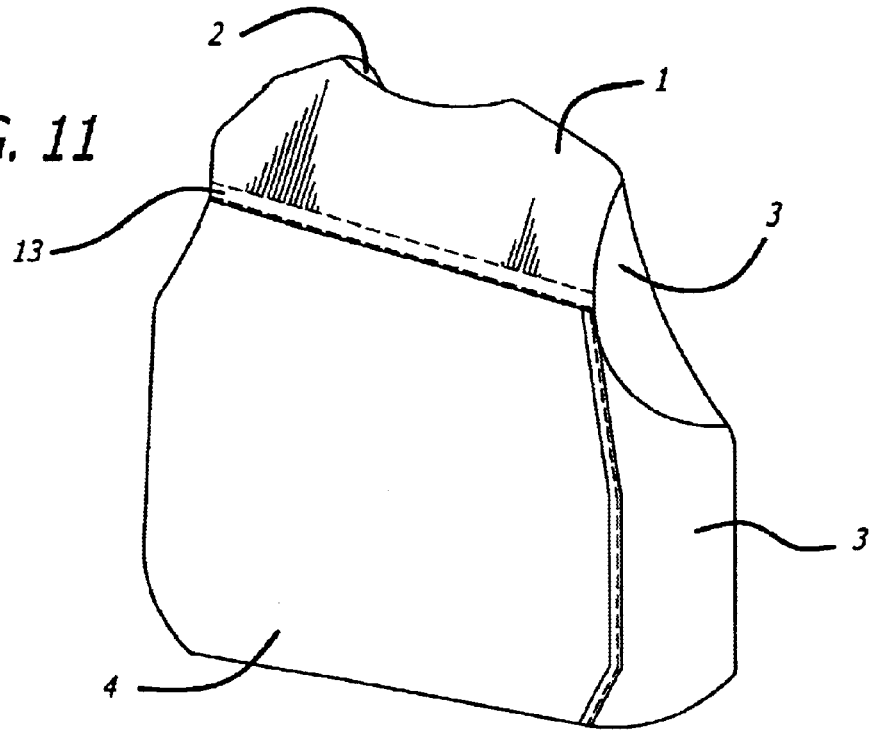
FIG. 11 is a perspective view of the back of an alternative exemplary embodiment of the present invention.

Use in the exemplary embodiment of adjustable shoulder and side strap assemblies enables production of general vest sizes (such as small, medium, large and XXL). It will be understood by someone with ordinary skill in the art that alternative shoulder and side connection materials could be used without departing from the spirit of the invention. However, doing so with non-adjustable materials would require production of size-specific vests (e.g., sizes 2 through 20) as opposed to adjustable general vest sizes. For example, as depicted in FIG. 11, the vest of the present invention could be constructed with a back floatation package 1 connected at the shoulders to front floatation panels, 2 and 3; the back non-floatation panel 4 would be connected to the lower edge 13 of the back floatation package 1; the sides of the back non-floatation panel 4 would be connected to the front floatation panels 2 (not shown) and 3 (shown).

Figure 12:
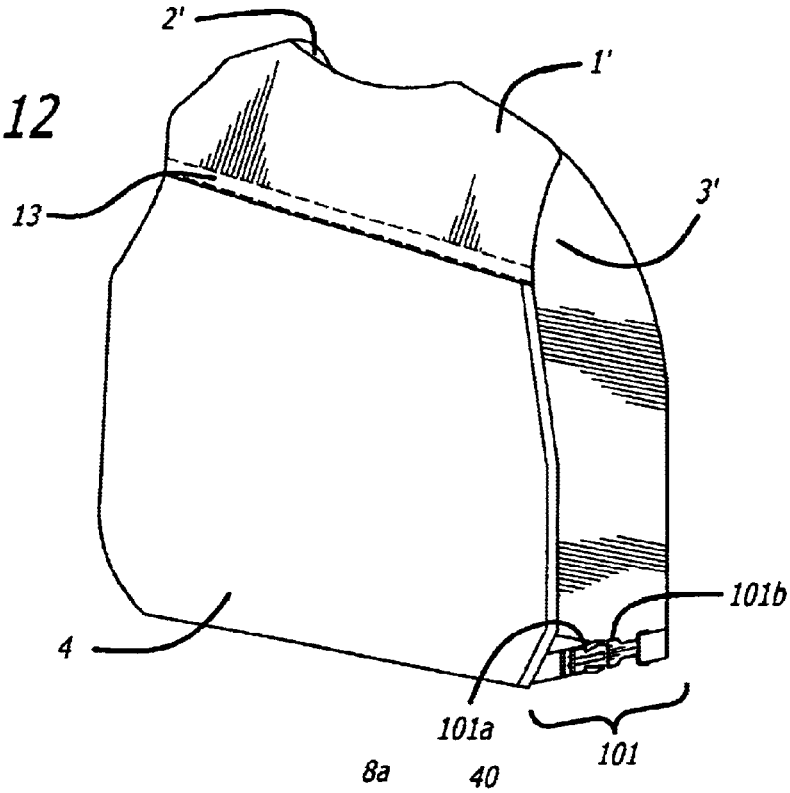
FIG. 12 is a perspective view of the back of a second alternative exemplary embodiment of the present invention.

Further, it will be understood by someone with ordinary skill in the art that in another alternative exemplary embodiment, a single floatation package could be provided as depicted in FIG. 12 with a front portion 2'/3' and a back portion 1'; the back portion 1' of the floatation package of the present invention would fit high on the back of the shoulders of a wearer; the front portion could be split in two to form two panels 2' and 3', or could be a single front panel 2'/3'. In such an embodiment, the back non-floatation panel 4 would be connected to the lower edge 13 of the back portion 1' of the floatation package and would extend vertically to the waist of the vest. The sides of the back non-floatation panel 4 could be connected to the sides of the front portion 2'/3' of the floatation panel either by stitching, straps, or other connecting means such as closure strapping means 101.

As depicted in FIG. 12, closure strapping means 101 could be attached at a waist level of the back non-floatation panel 4 and could connect to the front portion 2'/3' of the floatation package, such as with closure buckles connected to the left-most and right-most edges respectively of the front portion of the floatation panel. For example, a strap with a male buckle element 101*a* could be attached to each side, at waist level, of the back non-floatation panel 4; a strap with a female buckle element 101*b* could be attached to each side, at waist level, of the front portion of the floatation package 2'/3'; in one embodiment, the closure strapping straps could be adjustable.

Facsimile Reproduction of Copyright Material

A portion of the disclosure of this patent document contains material which is subject to copyright protection by the copyright owner, Lotus Designs, Inc. The copyright owner has no objection to the facsimile reproduction by anyone of the patent document or the patent disclosure, as it appears in the Patent and Trademark Office patent file or records, but otherwise reserves all copyright rights whatsoever.

Illustrative Embodiments

Although this invention has been described in certain specific embodiments, many additional modifications and variations would be apparent to those skilled in the art. It is, therefore, to be understood that this invention may be practiced otherwise than as specifically described. Thus, the embodiments of the invention described herein should be considered in all respects as illustrative and not restrictive, the scope of the invention to be determined by the appended claims and their equivalents rather than the foregoing description.

What is claimed is:

1. A personal floatation device to be worn as a life vest, said vest comprising:

a back floatation package extending horizontally across an upper back shoulder portion of the vest from an upper right back shoulder portion to an upper left back shoulder portion, said back floatation package having a lower edge, said lower edge extending horizontally from a rear left-arm mid-sleeve position to a rear right-arm mid-sleeve position;

a back non-floatation anchoring means connected to the lower edge of the back floatation package, said back non-floatation anchoring means extending vertically from the lower edge of the back floatation package to a waist securing means;

a left front floatation package having a left front shoulder portion;

a right front floatation package having a right front shoulder portion;

a right adjustable connecting means adjustably connecting the right back shoulder portion to the right front shoulder portion; and a left adjustably connecting means advisably connecting the left back shoulder portion to the left front shoulder portion.

2. The vest of claim 1, wherein the back non-floatation anchoring means comprises a panel of material.

3. The vest of claim 2, wherein the back non-floatation panel comprises mesh material.

4. The vest of claim 3, wherein the back non-floatation panel extends horizontally from a right side portion of a back of the vest to a left side portion of the back of the vest.

5. The vest of claim 2, wherein the waist securing means comprises a tunnel of material.

6. The vest of claim 5, said vest further comprising:

a first connecting means extending horizontally through the tunnel of the back non-floatation panel.

7. The vest of claim 6, said vest further comprising:

a second connecting means extending horizontally through the back non-floatation panel at a level below the lower edge of the back floatation package and at a level above the first connecting means.

8. The vest of claim 7, said vest further comprising:

a third connecting means extending horizontally through the back non-floatation panel at a level below the second connecting means and at a level above the first connecting means.

9. The vest of claim 1, said vest further comprising:

a left front floatation package having a left front shoulder portion;

a right front floatation package having a right front shoulder portion;

a right connecting means connecting the right back shoulder portion to the right front shoulder portion; and a left connecting means connecting the left back shoulder portion to the left front shoulder portion.

10. The vest of claim 9, wherein the back non-floatation anchoring means comprises a plurality of straps, wherein the straps are connected to the lower edge of the back floatation package, and wherein the straps provide the waist securing means of the back non-floatation anchoring means.

11. The vest of claim 9, wherein the back non-floatation anchoring means comprises a plurality of vertical straps, wherein each vertical strap is connected at a first end to the lower edge of the back floatation package, wherein the second end of each vertical strap forms a loop, and wherein the waist securing means of the back non-floatation anchoring means comprises the loops formed at the end of each strap.

12. The vest of claim 10, said vest further comprising:

a right front floatation package waist securing means; and a left front floatation package waist securing means.

13. The vest of claim 12, said vest further comprising:

a waist strapping means, wherein said waist strapping means is inserted through the vertical strap loops and is further inserted through the right front floatation package waist securing means and the left front floatation package waist securing means.

14. The vest of claim 1, wherein the back non-floatation anchoring means comprises a plurality of straps, wherein the straps are connected to the lower edge of the back floatation package, and wherein the straps provide the waist securing means of the back non-floatation anchoring means.

15. The vest of claim 1, wherein the back non-floatation anchoring means comprises a plurality of vertical straps, wherein each vertical strap is connected at a first end to the lower edge of the back floatation package, wherein the second end of each vertical strap forms a loop, and wherein the waist securing means of the back non-floatation anchoring means comprises the loops formed at the end of each strap.

16. A personal floatation device to be worn as a life vest, said vest comprising:

a left front floatation package having a left front shoulder portion;

a right front floatation package having a right front shoulder portion;

a back floatation package fitting high on the back shoulders of a wearer in a back shoulder yoke position, said back floatation package having a lower edge, said back floatation package adjustably connected to the left front shoulder portion of the left front floatation package; said back floatation package adjustably connected to the right front shoulder portion of the right front floatation package; and a back non-floatation panel connected to the lower edge of the back floatation package, said back non-floatation panel extending vertically from the lower edge of the back floatation package to a waist of the vest.

17. The vest of claim 16, said vest further comprising:

a first end of a first closure strapping means attached at a waist-level of a right side of the back non-floatation panel;

a first end of a second closure strapping means attached at a waist-level of a right side of the right front floatation package;

a first end of a third closure strapping means attached at a waist-level of a left side of the back non-floatation panel; and a first end of a fourth closure strapping means attached at a waist-level of a left side of the left front floatation package.

18. A personal floatation device to be worn as a life vest, said vest comprising:

a floatation package comprising a front portion and a back portion;

the back portion of said floatation package fitting high at a back shoulder position, the back portion of said floatation package having a lower edge, a right shoulder portion and a left shoulder portion;

the front portion having a right shoulder portion and a left shoulder portion;

the right shoulder portion of the back portion adjustably connected to the right shoulder portion of the front portion;

the left shoulder portion of the back portion adjustably connected to the left shoulder portion of the front portion; and a back non-floatation panel connected to the lower edge of the back portion of the floatation package, said back non-floatation panel extending vertically from the lower edge of the back portion of the floatation package to a waist of the vest.

19. The vest of claim 18, wherein the front portion of the floatation package comprises a left front panel and a right front panel.

20. The vest of claim 19, wherein a right side of the back non-floatation panel is connected to a right side of the right front panel and wherein a left side of the back non-floatation panel is connected to a left side of the left front panel.

* * * * *